US011291240B1

(12) United States Patent
Bosch-Sanchez

(10) Patent No.: US 11,291,240 B1
(45) **Date of Patent: *Apr. 5, 2022**

(54) ROLLING PAPER STRUCTURES APPARATUS AND METHOD FOR CREATING SMOKING DEVICE

(71) Applicant: Carlos Juan Bosch-Sanchez, San Juan, PR (US)

(72) Inventor: Carlos Juan Bosch-Sanchez, San Juan, PR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/084,595

(22) Filed: Oct. 29, 2020

Related U.S. Application Data

(63) Continuation of application No. 16/938,195, filed on Jul. 24, 2020.

(51) Int. Cl.
*A24D 1/02* (2006.01)

(52) U.S. Cl.
CPC ..... *A24D 1/022* (2013.01)

(58) Field of Classification Search
None
See application file for complete search history.

(56) References Cited

U.S. PATENT DOCUMENTS

2015/0083142 A1* 3/2015 Sinclair, Jr. ..... A24C 3/00 131/108
2016/0088871 A1* 3/2016 Sinclair, Jr. ..... A24C 1/04 131/281
2019/0150503 A1* 5/2019 Duffy ..... A24D 1/022

FOREIGN PATENT DOCUMENTS

WO WO 2012/047642 A2 * 4/2012

* cited by examiner

*Primary Examiner* — Dennis R Cordray
(74) *Attorney, Agent, or Firm* — DBPR Legal LLC.; Walter O. Alomar-Jimènez, Esq

(57) ABSTRACT

A rolling paper structure and method for making a hand rolled smoking article wherein said rolling paper structure is filled with a filler material and rolled to form a smoking structure such as a cigarette. The rolling paper structure comprises detachable sections and it is configured to create smoking structure with an integrated mouthpiece.

4 Claims, 5 Drawing Sheets

ROLLING PAPER STRUCTURES APPARATUS AND METHOD FOR CREATING SMOKING DEVICE

RELATED APPLICATIONS

The present is a continuation of U.S. patent application Ser. No. 16/938,195 filed on Jul. 24, 2020.

STATEMENT REGARDING FEDERALLY SPONSORED RESEARCH AND DEVELOPMENT

N/A

BACKGROUND OF THE DISCLOSURE

Technical Field

The present disclosure relates to rolling paper structures apparatus and method for creating smoking device with an integrated mouthpiece.

Discussion of the Background

Smoking devices created by hand mainly use a conventional rolling paper structure which do not include filters or other means for preventing the smoking material from being drawn into the user's mouth. One method that is used to prevent smoking material from being drawn into a user's mouth is adding a filter which restricts the size of the opening by pinching or twisting the end of the rolling paper. While this method reduces or prevent the smoking material from being drawn into the user's mouth from the smoking device, it also increase the cost of the smoking devices making the assembling of the smoking device more cumbersome, alter the taste of the smoking material because an outside agent is introduce into a place of combustion, restricts the amount of air that can be drawn through the smoking devices and limit the consumption of the smoking material.

Another disadvantage of the smoking devices created by rolling a conventional rolling paper structure is that current rolling papers are harder to roll due to the dimensions which are too short to make a proper mouthpiece out of the available rolling paper structure. Further, current rolling paper structure lacks an easy method or structure to assists beginner with the smoking devices assembly.

It is, therefore, desirable a method and a rolling paper structure for creating a smoking device to be constructed in a manner that assists the user when making the smoking device by hand. It is also desirable that the rolling paper structure permits the creation of a mouthpiece out of the rolling paper without changing the taste of the entire smoking material. Therefore, the present disclosure is directed to overcome the problems or disadvantages associated with the prior art.

SUMMARY OF THE DISCLOSURE

In accordance with the principles of the current disclosure, the present exemplary embodiment is directed toward a rolling paper structure configured to provide a mouthpiece as an integrated portion of the rolling paper while assisting the user when making the smoking device by hand. The present invention comprises a rolling paper structure with at least a detachable portion which is removed to create a flap section that works as a mouthpiece.

According to another aspect, the present disclosure comprises a gumline with at least a detachable section, a first paper section having a first height and a second paper section coupled to the first paper section, wherein said second paper section comprises a height equal to the first height.

Another aspect of the present disclosure is to provides a method for rolling the rolling paper structure to create a smoking device with gum, coil, plus integrated mouth piece produced by folding the excess paper "flap" provided by the rolling paper structure.

According to another aspect, the present disclosure is directed to produce a rolling paper structure with a detachable section, wherein said detachable section comprises perforated elements limiting the detachable section with respect to the inner body of the rolling paper structure. The detachable section is intended to be remove in order to reduce a section of the rolling paper. The reduce section of the rolling paper is configured to be folded on to itself by half and into the remaining gun line after removal of the detachable section which is assisted by the perforated element. The reduce section is folded to create the flap section which is intended to be used as a mouthpiece.

According to another aspect, the present disclosure is directed to a method for creating a smoking device. The method comprising a rolling paper structure with a detachable section, wherein said detachable section comprises perforated elements limiting the detachable section with respect to the inner body of the rolling paper structure. The method includes removing the detachable section generating a reduce section of the rolling paper. Further, the reduce section of the rolling paper is configured to be folded on to itself by half and into the remaining gun line after the removal of the detachable section to create the flap section. Next, the smoking material is positioned over the remaining rolling paper structure and is rolled to create a smoking device with an integrated mouthpiece.

Another aspect of the present disclosure is to provides a method for rolling the rolling paper structure to create a smoking device without the need of external filters while preventing the smoking material from falling off at least one of the sides of the smoking device.

Another aspect of the present disclosure is to provides a method for rolling the rolling paper structure to create a smoking device, wherein said rolling paper comprises at least two detachable sections making the detachable section accessible to both right-handed and left-handed people. In accordance with the present exemplary embodiment the rolling paper structure comprises at least two detachable sections. The detachable section comprises perforated elements limiting the detachable section with respect to the inner body of the rolling paper structure. Depending on the users preference, more particularly if the user is right-handed and left-handed, at least one of the detachable sections is removed to create the flap section or reduce section.

The present disclosure may address one or more of the problems and deficiencies of the prior art discussed above. However, it is contemplated that the disclosure may prove useful in addressing other problems and deficiencies in a number of technical areas. Therefore, the claimed invention should not necessarily be construed as limited to addressing any of the particular problems or deficiencies discussed herein.

BRIEF DESCRIPTION OF THE DRAWINGS

The accompanying drawings, which are incorporated herein, constitute part of the specifications and illustrate the preferred embodiment of the disclosure.

DETAILED DESCRIPTION

Detailed descriptions of one or more preferred embodiments are provided herein. It is to be understood, however, that the present disclosure may be embodied in various forms. Therefore, specific details disclosed herein are not to be interpreted as limiting, but rather as a basis for the claims and as a representative basis for teaching one skilled in the art to employ the present invention in any appropriate system, structure or manner.

In the present disclosure, the terms "rolling paper structure" refers to any material used to be rolled creating a hollow structure for receiving a smoking material. The rolling paper structure material may vary however it is preferred to be made of an smokable substance including but not limited predominantly hemp, rice, tobacco, homogenized tobacco and/or natural leaf material such as plant leaves (e.g., banana, palm leaves, etc.) and the like. The purpose for selecting the smokable substance material for the rolling paper may vary but the function remains the same, which is to assist with supporting the smoking material being consume during the act of smoking. The smoking substance used as smoking material to fill the rolling paper may vary depending on the user, however it is preferred that the smoking material comprises a plant material. The plant material may include but is not limited tobacco and *cannabis*.

In accordance with the principles of the present disclosure it is preferred that the rolling paper structure is configured to have a quadrilateral shape, however other shapes might be selected al long it comprises a gum line with a detachable section and wherein said rolling paper structure is configure to be rolled creating a hollow structure for containing a smoking material generating a smoking device with an integrated mouthpiece.

Figure 1:
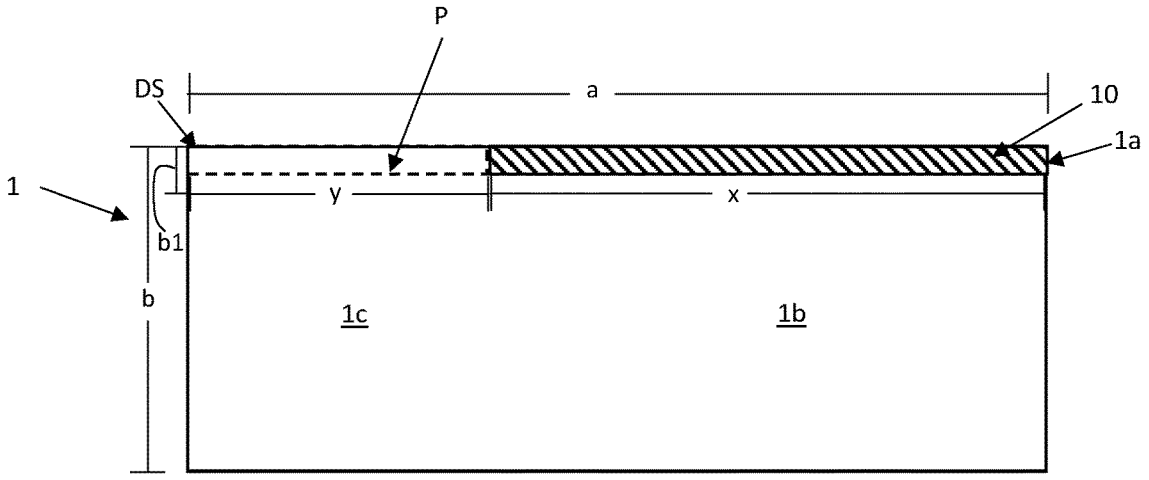
FIG. 1 shows a first exemplary embodiment in accordance with the principle of the present disclosure including a first rolling paper structure with at least a detachable section.

The first exemplary embodiment 1, in accordance with the principles of the present disclosure is shown in FIG. 1. The rolling paper structure 1 with a quadrilateral shape comprises a gumline section 1*a* including at least a detachable section DS, a reduced section 1*c* and a remain rolling paper section 1*b*. The gumline 1*a* comprising adhesive, glue or moisture-activated gum is disposed on a frontside rolling paper structure 1 surface at a position adjacent at least one edge and is configured to be in close contact with the remain rolling paper section 1*b*. The gumline 1*a* comprises a detachable section DS and a residual gumline 10. The area of the detachable section DS included in the gumline 1*a* is delimited by perforation element P which divide the reduce section 1*c* and residual gum line 10 from the detachable section DS. The detachable section DS is intended to be separated from the gumline 1*a* and the reduce section 1*c* wherein the perforation elements P assists with the removal of the detachable section DS. In accordance with the first exemplary embodiment the rolling paper may vary in dimensions, however it is intended to measure 16 cm long a and 1.25 inches wide b. Further the gumline 1*a* may vary in measure, however it is preferred to measure ⅖ of 1 cm wide b1 top to bottom as shown in FIG. 1. The reduce section 1*c* is delimited by the remain rolling paper section 1*b* and the detachable section DS. The remain rolling paper section 1*b* is delimited by the residual gumline 10 and reduce section 1*c*.

Figure 2:
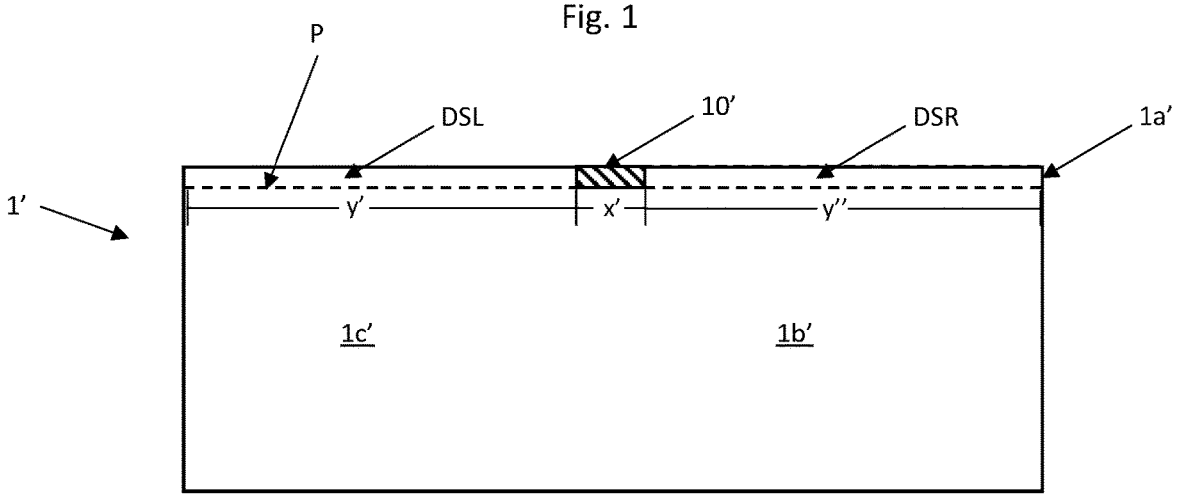
FIG. 2 shows a second exemplary embodiment in accordance with the principle of the present disclosure including a second rolling paper structure with at least two detachable sections.

The second exemplary embodiment, in accordance with the present disclosure, as shown in FIG. 2 discloses a second rolling paper structure 1' comprising at least two detachable sections DSL, DSR. The second rolling paper structure 1' is intended to comprise a first detachable sections DSL and a second detachable section DSR in order to assist with the creation of the mouthpiece depending on the user hand of preference. Like FIG. 1, the second rolling paper structure 1' includes a quadrilateral shape comprising a gumline section 1*a*', a second paper section 1*c*, a first paper section 1*b*. The difference with the second embodiment is that the structure comprises a gumline 1*a*' including at least two detachable sections, wherein said detachable sections comprises a first detachable section DSL, a residual gumline 10' and a second detachable section DSR. The gumline 1*a*' comprising adhesive, glue or moisture-activated gum is disposed on a frontside rolling paper structure 1' surface and it is configured to be in close contact with the first paper section 1*b*' and the second paper section 1*c*'. Now, in the second embodiment exemplary configuration the reduce section and the remain rolling paper depends on the detachable section removed by the user. For example, if a right hand user selects to remove the first detachable section DSL located at the gumline 1*a*' on the left side as shown in FIG. 2, the reduce section will be the section under the removed first detachable section, in the instant the second paper section 1*c*'. Further, the remain rolling paper comprises the first paper section 1*b*', the residual gumline 10' and the detachable section DSR. On the other hand, if a left hand user selects to remove the detachable section DSR included in the gumline 1*a*' on the right side as shown in FIG. 2, the reduce section will be the section under the removed detachable section, in the first paper section 1*b*' and the remain rolling paper comprises the second section 1*c*', the residual gumline 10' and the detachable section the detachable section DSL.

The gumline 1*a*', as mentioned before, comprises a residual gumline 10' and the detachable sections DSL, DSR. The area of the detachable section DSL, DSR are delimited by perforation element P. For example, the perforation element P delimiting the first detachable DSL divide the second section 1*c*' and residual gumline 10' from the first detachable section DSL. On the other hand, the perforation element P delimiting the second detachable DSR divide the first paper section 1*b*' and residual gumline 10' from the first detachable section DSR. During the procedure of creating the smoking device 1 at least one of the detachable sections DSL, DSR is intended to be removed from the gumline 1*a*' leaving a reduce section and a remain rolling paper section (depending on the users preference as explained above) wherein the perforation elements P assists with the removal of the selected detachable section.

In accordance with the second exemplary embodiment the rolling paper structure 1' may vary in dimensions, however it is preferred to measure 16 cm width a and 1.25 inches height b. Further the gumline 1*a*' may vary in measure, however it is preferred to measure ⅖ of 1 cm height b1 top to bottom as shown in FIG. 2. The resultant reduce section after the selected detachable section is removed is delimited by the remain rolling structure and the selected detachable section. The resultant remain rolling structure is delimited by the residual gumline 10', the not selected detachable section and the resultant reduce section.

Figure 3:
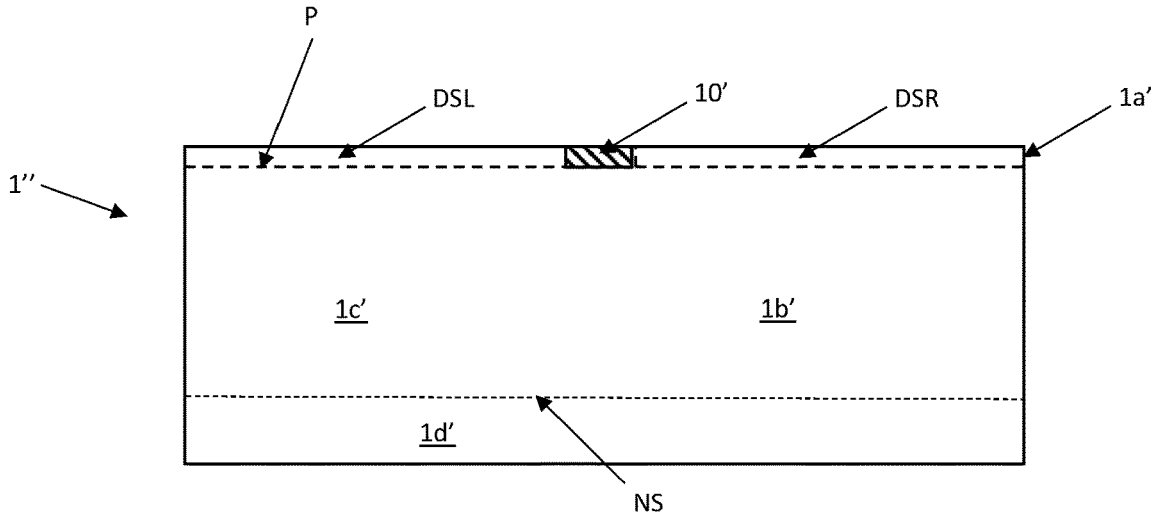
FIG. 3 shows a third exemplary embodiment in accordance with the principle of the present disclosure including a third rolling paper structure with at least two detachable sections.

The third exemplary embodiment, in accordance with the present disclosure, as shown in FIG. 3 discloses a third rolling paper structure 1" comprising at least two detachable sections DSL, DSR. The third rolling paper structure 1" is intended to comprise a gumline section 1*a*' including a first detachable sections DSL and a second detachable section DSR; a second paper section 1*c*, a first paper section 1*b* and a third paper section 1*d*' in order to assist with the creation of the mouthpiece depending on the user hand of preference. As explained before the rolling paper structure dimension may vary. For example, a king size paper comprising a quadrilateral shape comprising a size bigger could be used instead of the preferred in the first or second exemplary embodiment. Either way the rolling paper structure comprises at least a detachable section DSL, DSR, a gumline 1*a*', a second paper section 1*c* and a first paper section 1*b*' as explained above. The preferred size for the king size paper is 19 cm long and 2 inches wide. The gum line 1*a*' is preferred to comprise at least ⅖ of 1 cm height (top to bottom). The detachable sections are delimited by perforations perforated, as explained above, for easy removal. The detachable sections DSL, DSR comprises a first detachable section DSL and a second detachable section DSR. The dimension of the detachable sections may vary, however it is preferred to comprise a width of 8 cm each y',y" and the residual gum line 10' between the detachable sections DSR, DSL, which is not perforated. The residual gumline is preferred to have a width x' of a 3 cm. Further, a third paper section 1*d*' includes perforations NS to delimited contact with the first paper section 1*b*' and second paper section 1*c*'. The third section is intended to be remove in case the user wanted to reduce the height of the rolling paper structure 1". The third paper section 1*d*' removal is assisted by the perforations NS.

Figure 4:
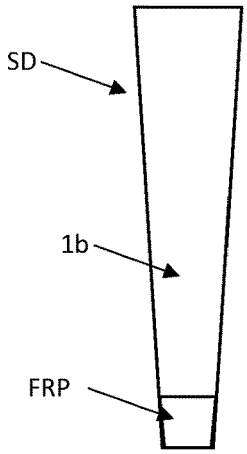
FIG. 4 shows a first exemplary embodiment in accordance with the principle of the present disclosure including a first smoking device with an integrated mouthpiece.

FIG. 4 is directed to the smoking device SD comprising a rolling paper structure with at least a removed detachable section DS, a reduce section 1*c* folded into the remain rolling paper section 1*b* to create a mouthpiece. The remain rolling paper section 1*b* is rolled to generate a hollow structure and subsequently be filled with the smoking material SM. The procedure to fill the pre-folded smoking device SD with smoking material is explained below.

The cone shaped pre-folded smoking device SD, as in FIG. 4, is an alternative for people who are unable or unwilling to roll a rolling paper structure 1. The cone shape may vary in measure, but it is preferred to be between 6 cm and 16 cm. The dimension is limited by the folded reduce section and the rolling process of the remain rolling paper structure. The reduce section 1*c* is folded into a mouthpiece which is made from the same rolling paper structure 1 without the need of an outside filter or mouthpiece.

Figure 5:
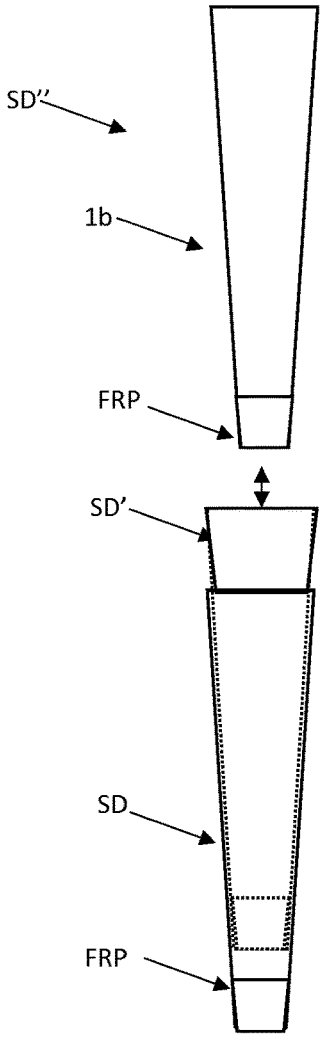
FIG. 5 shows a first exemplary embodiment in accordance with the principle of the present disclosure including an arrangement of pre-folded smoking devices with an integrated mouthpiece for distribution.

FIG. 5 shows an arrangement of pre-folded smoking devices SD' with an integrated mouthpiece FRP, wherein said mouthpiece FRP is made from the folding action of reduce paper section 1*c*. Several pre-folded smoking devices SD' are formed and stack by inserting the pre-folded smoking devices SD' into each other, more particularly inserting the mouthpiece through the opening of the hollow structure formed by the folded remain rolling paper structure 1*b*.

Figure 6A:
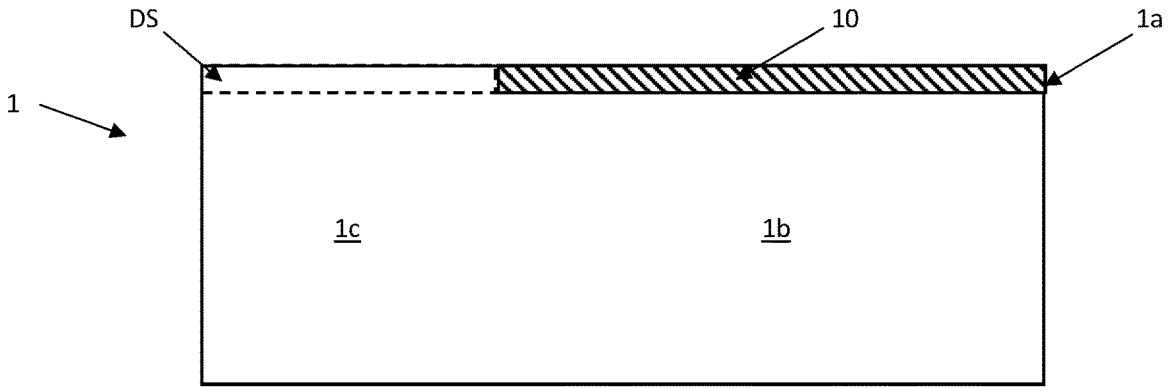
FIGS. 6A-6F shows an exemplary embodiment of the steps for rolling the paper structure with at least a detachable section in accordance with the principle of the present disclosure.
Figure 6B:
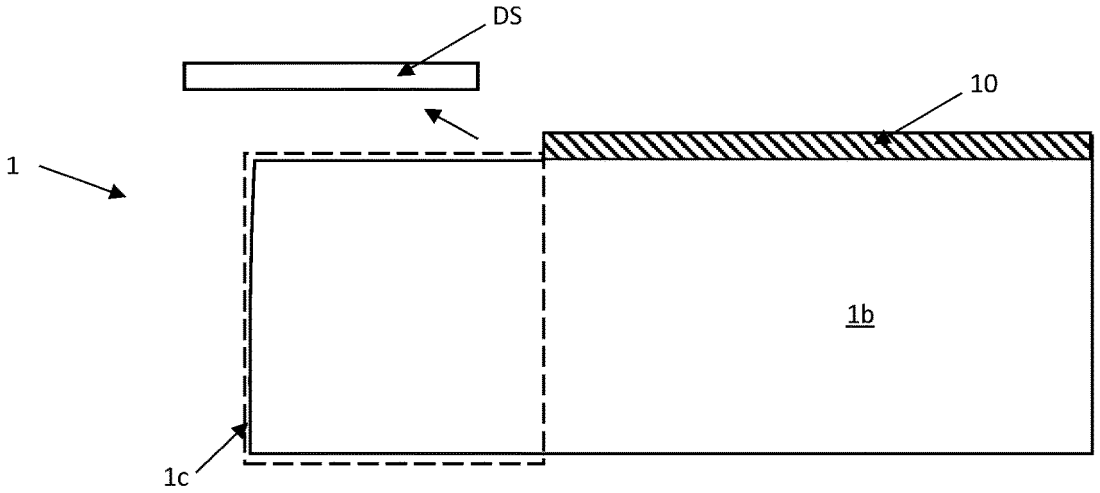
Figure 6C:
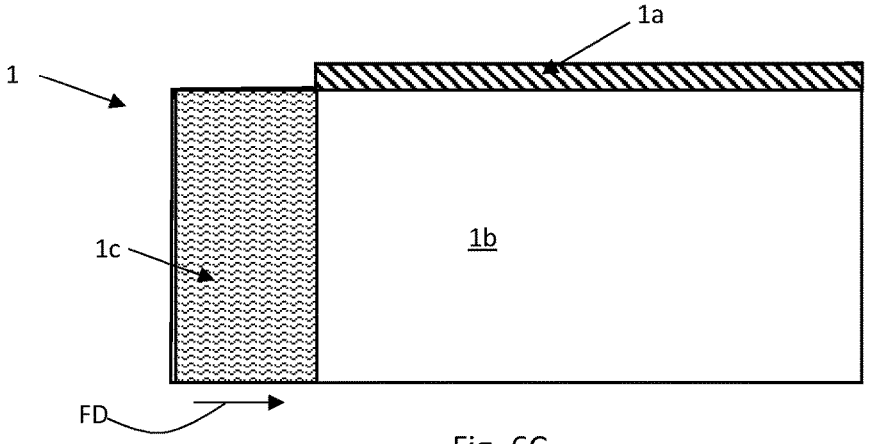
Figure 6D:
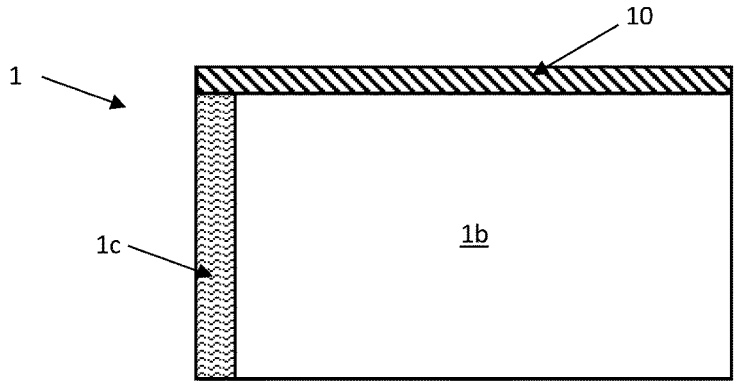

FIGS. 6A through 6F are directed to the methodology to make a smoking device SD with an integrated mouthpiece FRP using the rolling paper structure 1,1' comprising at least a detachable section DS. The process is defined as follows:

a. Provide a rolling paper structure with at least a detachable section. See FIG. 6A.
b. Remove the detachable section from the gum-line which are already perforated a shown in FIG. 6B.
c. Once a detachable section is removed start folding the reduced section toward the remain rolling paper section as shown in FIG. 6C.
d. Fold the reduced section several times until it reaches the remain rolling paper section and it is tucked under the gumline as shown in FIG. 6D. For example, and in accordance with the principles of the present disclosure the reduced section is folded at least 4 times down the middle plus one last time so that it reaches the remain rolling paper section and it is tucked under the residual gumline 10.
e. Rolled the remain rolling paper section 1*b* including the reduced section 1*c* achieving a hollow structure with a mouthpiece FRP defined by the folded reduce section 1*b* at the distal end of the smoking device SD as shown in FIG. 6F.

Figure 6E:
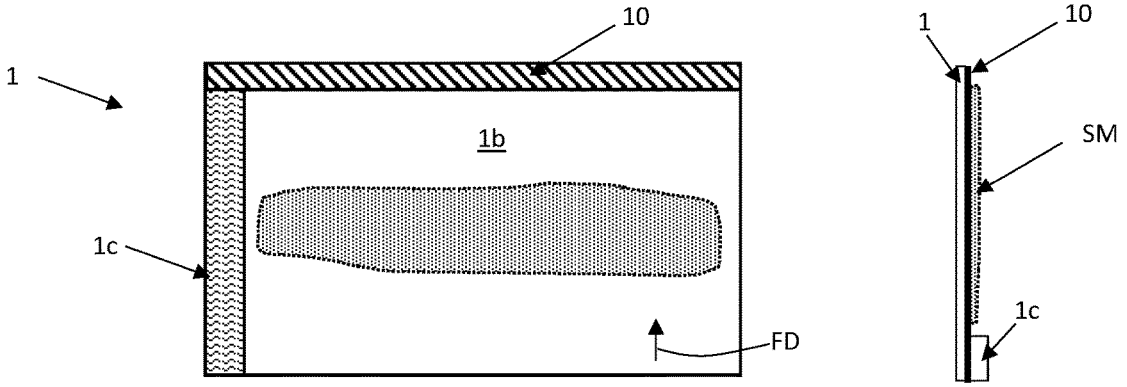
Figure 6F:
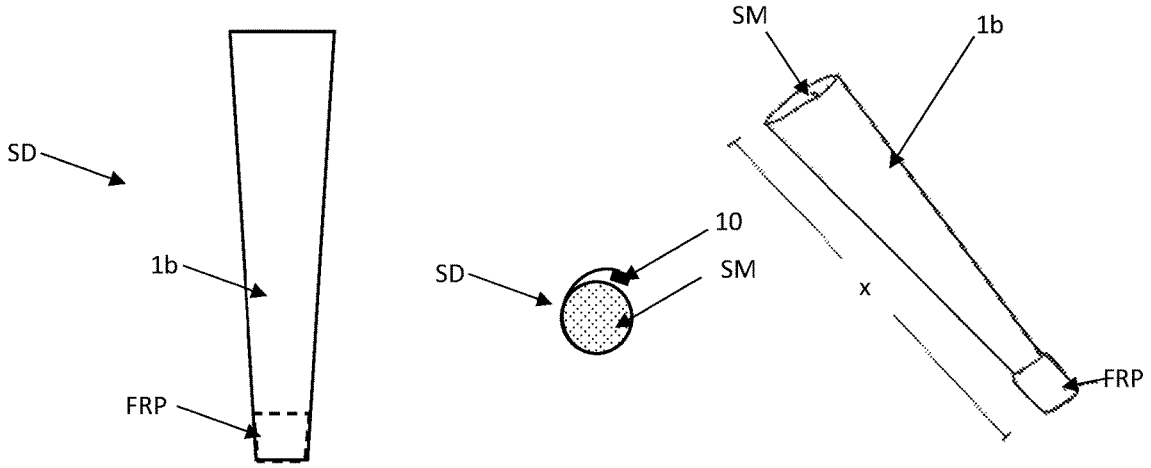
Figure 7:
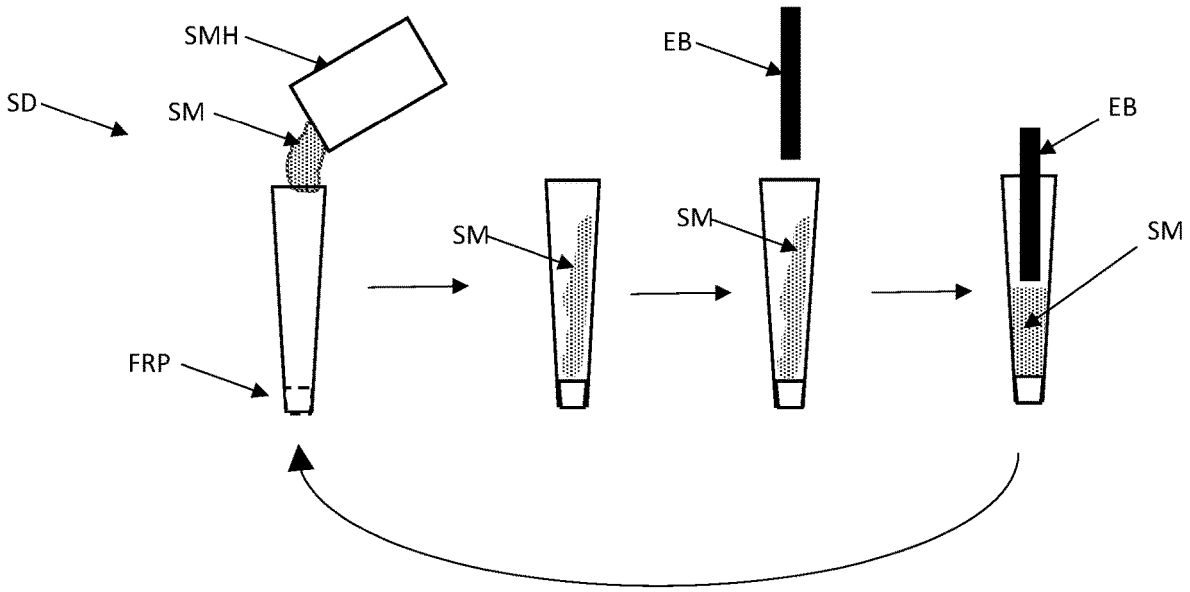
FIG. 7 shows an exemplary embodiment of the steps for filling a pre-folded smoking device with an integrated mouthpiece accordance with the principle of the present disclosure.
Figure 8:
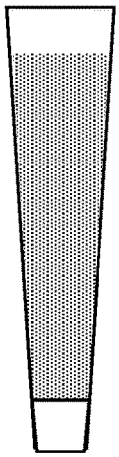
FIG. 8 shows an exemplary embodiment a smoking device with an integrated mouthpiece filled with the smoking material in accordance with the principle of the present disclosure.

Further, the smoking device SD could be filled with the smoking material before the rolling procedure of the remain rolling paper section, as shown in FIG. 6E or after the rolling procedure as shown in FIG. 7. If the smoking material SM is added before the rolling procedure of the remain rolling paper section the smoking material is positioned on top of the remain rolling paper section 1*b* between residual gumline 10 and the folded reduced section 1*c*. The rolling direction may vary, however the preferred folding direction FD is from the opposite end of the gumline 1*a* toward the residual gumline 10 covering the smoking material SM. The gumline 1*a*, more particularly the residual gumline 10 assists with holding the final rolling configuration in place with its adhesive properties, as shown in FIG. 6F.

FIG. 7 is directed to the procedure to fill the smoking device SD with the smoking material SM after the cone configuration is achieved. In other words, the smoking material SM is added to pre-folded smoking devices as explained in FIG. 4. Once the pre-folded smoking device SD is created the hollow structure is filled by inserting the smoking material SM through the opening located at the distal end of the smoking device SD opposed to the mouthpiece FRP. The smoking material SM located at the container SMH is pour into the smoking device SD. Using an elongated body EB with a flat surface the smoking material is pushed inside the hollow structure. The procedure of pouring and pushing the smoking material SM into the hollow structure is repeated until the hollow structure of the smoking device SD is full or until the user desires. The smoking material SM is intended to be pushed inside the hollow structure between the mouthpiece FRP and the distal end of the smoking device SD opposed to the mouthpiece FRP.

The method to make a smoking device SD with an integrated mouthpiece FRP using the rolling paper structure 1,1' with king size measures is the same as stated in FIGS. 6A through 7.

In accordance with the principles of the present disclosure the smoking device with integrated mouthpiece overcome the problem of the previous smoking devices make by hand. Further, it will be apparent to those skilled in the art that various modifications and variations can be made to the method and system described in the present disclosure. Other embodiments of the method and system will be apparent to those skilled in the art upon consideration of the specification and practice of the method and system disclosed herein. It is intended that the specification and examples be considered as exemplary only, with a true scope of the disclosure being indicated by the claims.

The invention claimed is:

1. A smoking device comprising;

a rolling paper structure comprising a quadrilateral shape, wherein said quadrilateral shape comprises a length, wherein said length comprises a first distal end and a second distal end;

wherein said quadrilateral shape comprises a width perpendicular to the length;

wherein said width comprises a top distal end and a bottom distal end;

wherein said quadrilateral shape comprises a gumline section, a reduced section having reduced width and a remaining rolling paper section;

wherein said gumline section extends parallel to the length and is located at the top distal end;

wherein said reduced section is adjacent to said remaining rolling paper section;

wherein the reduced section extends parallel to the length and from the first distal end toward the remaining rolling paper section;

wherein the remaining rolling paper extends parallel to the length and from the reduced section toward the second distal end;

wherein said gumline section comprises an adhesive surface, wherein said gumline section comprises at least a first detachable section and a residual gumline;

wherein the first detachable section comprises perforation elements;

wherein the perforation elements delimit the contact of the first detachable section with the residual gumline;

wherein the perforation elements delimit the contact of the first detachable section with the reduced section;

wherein said first detachable section is detached from reduced section and the residual gumline; and wherein the reduced section is folded parallel to the length and toward the remaining rolling paper.

2. The smoking device as in claim 1, wherein said rolling paper structure is rolled into a single rolling paper structure, wherein said single rolling paper structure comprises a hollow structure with a mouthpiece, wherein said mouthpiece is located at a first distal end of the hollow structure, wherein said mouthpiece comprises said folded reduced section;

wherein said hollow structure comprises an opening at a second distal end; and wherein said mouthpiece is made of the same material as the rolling paper and is integrally made with the hollow structure.

3. The smoking device as in claim 2, wherein said smoking device comprises a conical shape.

4. The smoking device as in claim 1, wherein the gumline section comprises a second detachable section, wherein the second detachable section extends parallel to the length and from the second distal end toward the first detachable section, wherein said second detachable sections comprises perforation elements;

wherein the perforation elements delimit the contact of the second detachable section with the residual gumline;

wherein the perforation elements delimit the contact of the second detachable section with said remaining rolling paper section;

wherein said first detachable section is detached from reduced section and the residual gumline a first detachable section and a second detachable section; and wherein the residual gumline is positioned between the first detachable section and the second detachable section.

* * * * *